United States Patent [19]

Thor

[11] 4,271,972

[45] Jun. 9, 1981

[54] TAMPERPROOF OVERCAP

[75] Inventor: David L. Thor, Naperville, Ill.

[73] Assignee: Container Corporation of America, Chicago, Ill.

[21] Appl. No.: 60,147

[22] Filed: Jul. 24, 1979

[51] Int. Cl.[3] ..... B65D 49/12

[52] U.S. Cl. ..... 215/251; 215/253; 215/277

[58] Field of Search ..... 215/277, 275, 251, 253

[56] References Cited

U.S. PATENT DOCUMENTS

| | | | |
|---|---|---|---|
| 208,193 | 9/1878 | Michel | 215/277 |
| 495,775 | 4/1893 | Bonnamy | 215/275 |
| 3,480,171 | 11/1969 | Rohde | 215/251 |

*Primary Examiner*—Donald F. Norton

*Attorney, Agent, or Firm*—Richard W. Carpenter

[57] ABSTRACT

A tamperproof, molded plastic overcap for a container having a plug closure.

11 Claims, 5 Drawing Figures

TAMPERPROOF OVERCAP

SUMMARY OF THE INVENTION

This invention relates to closure arrangements and more particularly to an overcap closure arrangement for a necked container having a plug type primary closure.

It is an object of the invention to provide, in a closure arrangement of the type described, an overcap which is tamperproof in that portions have to be permanently destroyed in order to open the container, so that there is visible evidence of opening once the closure has been opened.

Another object of the invention is to provide a one-piece, molded plastic overcap which can be readily snapped and locked onto the neck of a container, but which thereafter cannot be removed without destroying the integrity of the closure.

A more specific object of the invention is the provision of an overcap which includes a locking ring which snugly and permanently receives a neck flange of the container and a top wall which is detachably removable to afford access to a plug closure.

These and other objects of the invention will be more apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
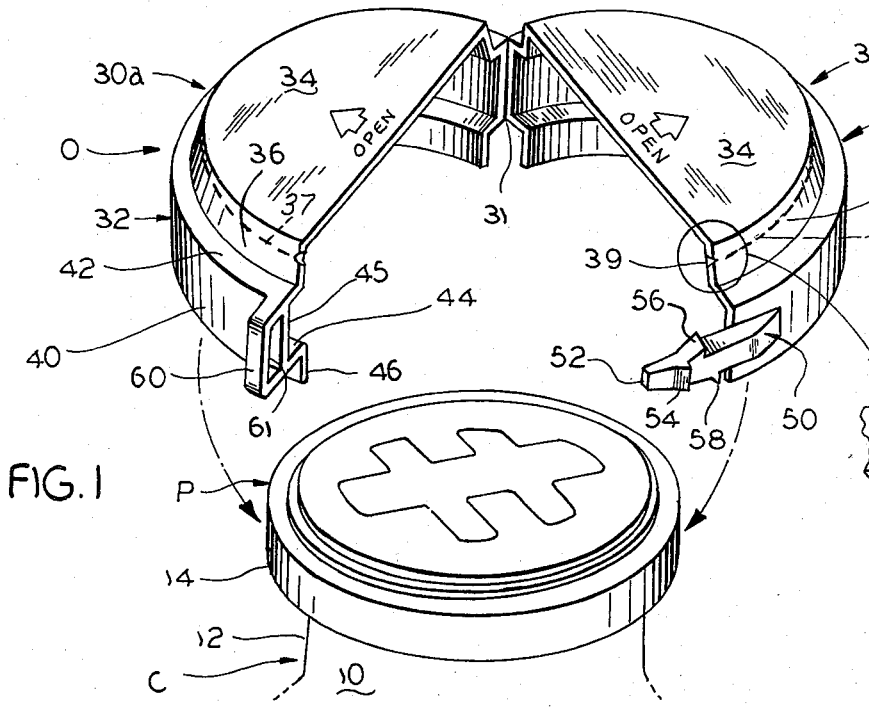
FIG. 1 is an exploded perspective view of a closure arrangement embodying features of the invention.

Referring now to the drawings for a better understanding of the invention, and particularly to FIG. 1, it will be seen that the novel overcap embodying features of the invention, and indicated generally at O, is applied to a container C having a conventional plug closure P.

Figure 4:
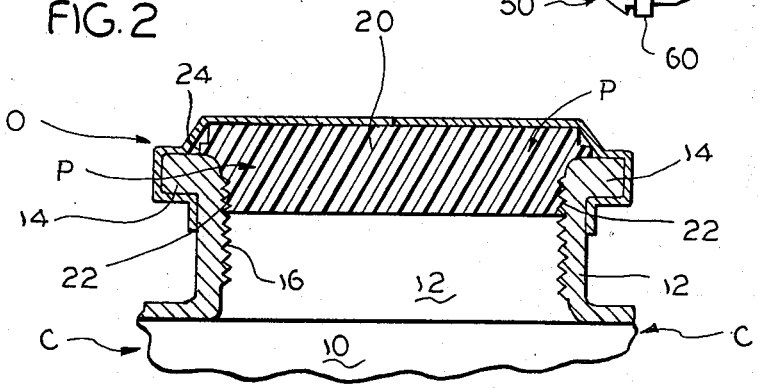
FIG. 4 is a transverse, vertical section taken on line 4—4 of FIG. 2.

As best seen in FIGS. 1 and 4, container C has a body 10 from which projects an integral neck 12 with an outwardly extending annular flange 14. Neck 12 is provided with internal threads 16 adapted to engage threads 22 on a body 20, of a plug closure P, which may include a small outwardly projecting flange 24 adapted to seat on the upper surface of container neck 12.

Overcap O has a generally cylindrical body 30 which is split to provide a pair of generally similar semi-cylindrical body sections 30*a* and 30*b*, which have corresponding end portions joined together by an integral hinge 31, as best seen in FIG. 1.

The overcap body includes an annular locking ring 32 and a generally flat, circular top wall 34 which are interconnected by an integral, annular, outwardly and downwardly sloping side wall 36.

Figure 5:
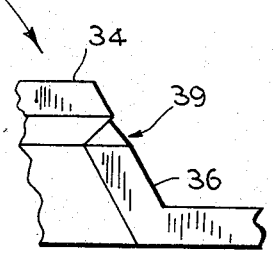
FIG. 5 is an enlarged perspective view of a portion of the structure illustrated in FIG. 1.
Figure 2:
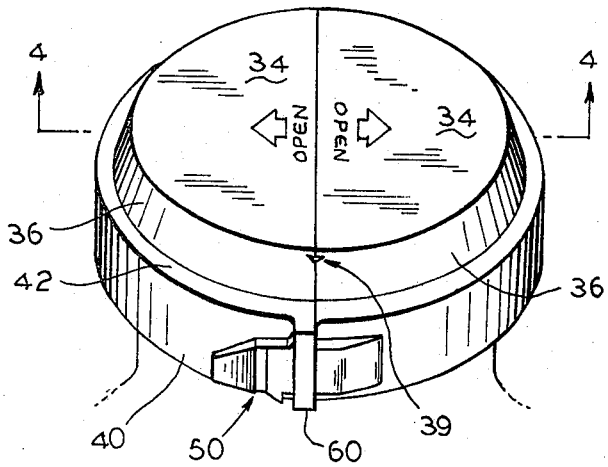
FIG. 2 is a perspective view of the structure of FIG. 1, shown in a closed position.
Figure 3:
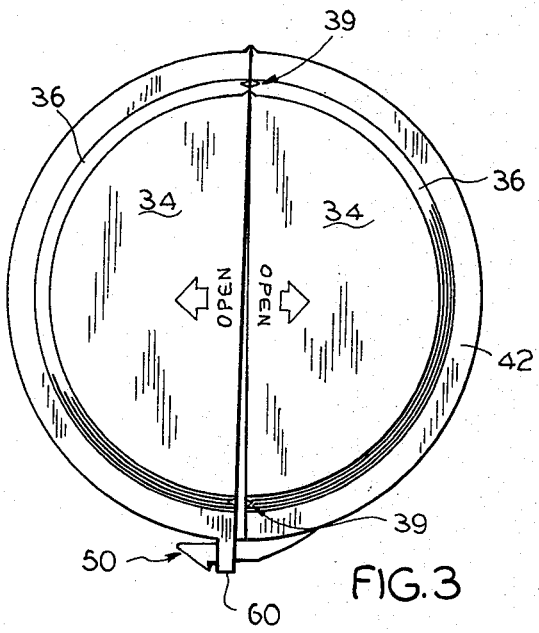
FIG. 3 is a plan view of the structure of FIG. 2.

As best seen in FIG. 5, at its upper end side wall 36 is provided with an internal V-shaped groove 37 which is in effect a weakened line of tear to permit the top wall 34 to be removed from the side wall 36, in a manner hereinafter described, to afford access to plug closure P. Also at the edges of the side wall 36 of each body section there may be provided notches 39 which assist in tearing the top wall 34 off the overcap 30.

Locking ring 32, as best seen in FIGS. 1 and 4, comprises a vertical, outer, main wall 40 having a pair of upper and lower horizontal walls 42 and 44, respectively; extending inwardly therefrom to define therewith an annular groove or channel 45 for receiving the neck flange 14 of container C, as shown in FIG. 4. Locking ring 32 may also include an integral annular skirt 46 depending from the inner periphery of lower horizontal wall 44.

As best seen in FIG. 1, overcap O is adapted to be placed over the container C and plug closure P, with the hingedly interconnected body sections 30*a* and 30*b* brought together and secured in place by means of latch type locking means which includes a male member 50 and a female member 60 formed integrally with body 30 on body sections 30*b* and 30*a* respectively.

Male member 50 includes an arrow shaped head 52 having a plurality of shoulders 54, 56, and 58 spaced from each other rearwardly of head 52.

Female member 60 is in the form of a rectangular loop which defines an opening or eye 61 for receiving the head 52 of male member 50, with one of the shoulders engaging the far side of the female member adjacent eye 61 to prevent its removal therefrom. The base of the head 52 and the shoulders are wider than the opening 61, so that once the head has been forced through the opening, it cannot be removed.

The purpose of providing a plurality of tapered shoulders is to assure a firm seating of one of the shoulders against the female member 60. In the event of imperfections in the molding of the piece, if the male member cannot be inserted far enough into eye 61 to engage shoulder 58, then it can engage shoulder 56 or at least shoulder 54.

Thus, after the overcap has been placed in position over the sealed container with plug closure P in place, the body sections 30*a* and 30*b* are locked together. Thereafter, in order to have access to plug closure P to open the container it is necessary to insert an object under the edges of top wall 34, at the parting line between the body sections and then tear off the top wall at groove 37 located at the juncture of the side and top walls.

When this has been done the integrity of the overcap has been destroyed and reclosure cannot be effected, so that the closure is tamperproof.

Also, when male member 50 is withdrawn from female member 60, the engaging shoulder (54, 56, or 58) destroys the integrity of female member 60 so that the closure lock cannot be reused.

By "integrity" is meant the untouched or undamaged appearance. Thus, when the cap is opened initially, portions of the cap are destroyed, so the cap no longer has an "unopened" look. Thus, it is apparent that it has been opened or "tampered with". The purpose of a "tamperproof" closure is to make it apparent to an observer when the closure has been initially opened, so it cannot be sold as a new or unopened package.

I claim:

1. In a closure arrangement for a container having a neck with an outwardly projecting annular flange and a plug type closure adapted to be received within said neck, a unitary, molded plastic, tamperproof overcap, comprising:

(a) a hollow body including a pair of generally similar, semi-cylindrical body sections having corresponding ends joined by integral hinge means;

(b) said body sections including a detachably removable top wall and a locking ring adapted to snugly engage said container neck flange;

(c) said locking ring including integral locking means, for interconnecting the free ends thereof, which are readily attachable to each other but which cannot be detached from each other without being destroyed.

2. A closure arrangement according to claim 1, wherein said overcap includes an annular weakened line of tear facilitating the detachment of said top wall from the remainder of said overcap.

3. A closure arrangement according to claim 1, wherein said top wall and locking ring are joined by a side wall having an annular groove for facilitating detachment of said top wall.

4. A closure arrangement according to claim 3, wherein said groove is on the inside of said overcap.

5. A closure arrangement according to claim 3, wherein said groove is on the inside of said side wall.

6. A closure arrangement according to claim 1, wherein said locking ring includes an outer vertical wall and a pair of upper and lower horizontal walls extending inwardly therefrom and defining therewith an annular channel for receiving said container neck flange.

7. A closure arrangement according to claim 6, wherein said locking ring includes an integral skirt depending from the inner end of said lower horizontal wall.

8. A closure arrangement according to claim 1, wherein said locking means are of the latch type and include an arrow shaped male member and a female member having an opening for receiving said male member.

9. A closure arrangement according to claim 8, wherein said male member includes a tapered head having a width slightly larger than said opening so that it has to be forced through said opening and cannot thereafter be withdrawn thereform.

10. A closure arrangement according to claim 9, wherein said male member includes a plurality of shoulders spaced from each other rearward of said head and each being of a width which is slightly larger than the opening of said female member.

11. A closure arrangement according to claim 8, wherein the withdrawal of said male member from said female member destroys the integrity of said female member to prevent reuse.

* * * * *